US011519229B1

(12) United States Patent
Li et al.

(10) Patent No.: US 11,519,229 B1
(45) Date of Patent: Dec. 6, 2022

(54) TRUCK-MOUNTED FLIPPED AUTOMATED OPERATION EQUIPMENT FOR WELL WORKOVER

(71) Applicant: Huangshan Huaneng Petrochemical Machinery Co., Ltd., Huangshan (CN)

(72) Inventors: Yongbin Li, Huangshan (CN); Yang Li, Huangshan (CN); Yingda Chen, Huangshan (CN); Jie Jiang, Huangshan (CN); Xiaojun Huang, Huangshan (CN); Liping Zhou, Huangshan (CN)

(73) Assignee: HUANGSHAN HUANENG PETROCHEMICAL MACHINERY CO., LTD., Huangshan (CN)

( * ) Notice: Subject to any disclaimer, the term of this patent is extended or adjusted under 35 U.S.C. 154(b) by 0 days.

(21) Appl. No.: 17/513,927

(22) Filed: Oct. 29, 2021

(51) Int. Cl.
*E21B 15/00* (2006.01)
*E21B 19/10* (2006.01)

(52) U.S. Cl.
CPC ..... *E21B 19/102* (2020.05); *E21B 15/003* (2013.01)

(58) Field of Classification Search
CPC ..... E21B 15/003
See application file for complete search history.

(56) References Cited

FOREIGN PATENT DOCUMENTS

CN 111173461 A * 5/2020
CN 111852357 A * 10/2020
CN 112145099 A * 12/2020 ..... E21B 15/003

* cited by examiner

*Primary Examiner* — Matthew R Buck
(74) *Attorney, Agent, or Firm* — Bayramoglu Law Offices LLC

(57) ABSTRACT

A truck-mounted flipped automated operation equipment for a well workover, which includes a derrick and an operation platform. A guide rail is arranged on the front and back sides of the center of the operation platform, respectively, and a hydraulic clamp mechanism is arranged on the guide rail. An inner clamp frame support is arranged under the derrick, and a lifting cylinder is fixed on the left side of the derrick. The piston part of the lifting cylinder is provided with a fixed plate configured to rise and fall with the lifting cylinder, and the right side of the operation platform is hinged on the fixing plate. The fixed plate is further provided with a flipped cylinder. The cylinder barrel of the flipped cylinder is hinged on the fixed plate, and the piston part of the flipped cylinder is connected to the lower part of the operation platform.

11 Claims, 4 Drawing Sheets

TRUCK-MOUNTED FLIPPED AUTOMATED OPERATION EQUIPMENT FOR WELL WORKOVER

TECHNICAL FIELD

The present invention relates to a truck-mounted flipped automated operation equipment for a well workover.

BACKGROUND

At present, most workover rig operations are mainly used for the lifting process of oil pipe and other equipment, as well as other processes such as the process of moving the oil pipe from the pipe rack to the crane still need to be completed mainly by workers. Although there are some automations at present, they are not convenient to move and disassemble, a crane for hoisting is required, and the need to assemble and disassemble liquid-gas electric pipelines is time consuming, and etc., thereby not satisfying the requirements of the existing minor workover operation.

SUMMARY

An objective of the present invention is to provide a truck-mounted flipped automated operation equipment for well workover to solve the problem that the prior workover equipment has a low degree of integration, and does not have a highly integrated operation platform, and requires on-site installation of hydraulic s and other mechanisms. There is also a problem that it is inconvenient for transportation and required to spend a lot of manpower and material resources on installation and disassembly before and after use.

The present invention adopts the following technical solutions to solve the technical problems. A truck-mounted flipped automated operation equipment for well workover includes a derrick and an operation platform. A slip for clamping the pipe string is arranged at the center of the operation platform. The slip is arranged on a flange of a pipe mouth on the operation platform; a guide rail is arranged on front and back sides of the center of the operation platform, respectively, and the guide rail is provided with a hydraulic clamp mechanism configured to slide along the guide rail. The hydraulic clamp mechanism includes a hydraulic clamp frame and a hydraulic clamp arranged on the hydraulic clamp frame. An inner clamp frame support is arranged under the derrick, and a lifting cylinder is fixed on the left side of the derrick. A piston part of the lifting cylinder is provided with a fixed plate configured to rise and fall with the lifting cylinder, and the right side of the operation platform is hinged on the fixed plate. The fixed plate is further provided with a flipped cylinder. A cylinder barrel of the flipped cylinder is hinged on the fixed plate, and a piston part of the flipped cylinder is connected to the lower part of the operation platform. The inner clamp frame support is provided with a placement groove adapted to the hydraulic clamp mechanism. The hydraulic clamp mechanism is configured to flip vertically with the operation platform, and when the hydraulic clamp mechanism runs to the end of the guide rail, the hydraulic clamp mechanism is placed on the placement groove.

Further, a well support mechanism is arranged on the left side of the operation platform away from the derrick.

Further, the front and back sides of the center of the operation platform are symmetrically provided with a pipe string centring mechanism.

Further, the flipped cylinder is arranged under the front and back sides of the operation platform, respectively.

Further, the lifting cylinder is arranged on the front and back sides of the end of the operation platform, respectively.

Further, a liquid accumulation tank is arranged at the center of the operation platform, the pipe mouth of the operation platform is arranged at the center of the liquid accumulation tank, and a liquid discharge outlet is arranged at the bottom of the liquid accumulation tank.

Further, the outer side wall of one of two guide rails is provided with a rack, and the rack is engaged with and adapted to a gear. The outer side wall of the bottom of the hydraulic clamp frame is provided with a hydraulic motor, and the gear is arranged on a rotating shaft of the hydraulic motor.

Further, the well support mechanism includes a well support base installed on the operation platform. A flipped well support is hinged on the well support base, and a grip for clamping the pipe string is arranged on the well support. A three-position cylinder is arranged on the well support base. A cylinder barrel of the three-position cylinder is hinged on the well support base, and the top of a piston part of the three-position cylinder is connected to the well support. The well support is a square frame, and a bottom frame of the well support is hinged on the well support base. Specifically, two three-position cylinders are arranged, and the tops of piston parts of the two three-position cylinders are hinged with a front frame and a back frame of the well support, respectively. The grip is arranged on a top frame of the well support.

Further, the pipe string centring mechanism includes a centring fixed base, and two centring mechanisms are symmetrically arranged on the centring fixed base relative to the wellhead. Each centring mechanism includes a side push cylinder, a rotary base, a guide base, a semi-pipe positioning sleeve, an adjusting plate, and a side swing cylinder. The bottom of the rotary base is hinged to the centring fixed base. The bottom of the cylinder barrel of the side swing cylinder is hinged to the centring fixed base, and the piston part of the side swing cylinder is hinged to the right side wall of the rotary base. The guide base is retractably arranged on the top of the inner chamber of the rotary base. The cylinder barrel of the side push cylinder is fixed on the left side wall of the rotary base, and the piston part of the side push cylinder is hinged to the left side wall of the guide base. The adjusting plate is arranged on the top of the guide base. The semi-pipe positioning sleeve is arranged on the adjusting plate, and the semi-pipe positioning sleeve is configured to clamp the pipe string. When the semi-pipe positioning sleeves of the two centring mechanisms are docked with each other, the semi-pipe positioning sleeves cooperate to clamp the pipe string.

Further, the truck-mounted flipped automated operation equipment for the well workover further includes a standing column fixed on the derrick. The standing column is provided with a guide groove. A roller assembly is arranged in the guide groove, and is configured to rise and fall along the guide groove. The roller assembly includes a roller configured to rise and fall along the guide groove, and the center of the roller is provided with a roller shaft. The lifting cylinder is fixed at the bottom of the standing column, and the piston part of the lifting cylinder is connected to the roller shaft. The fixed plate is arranged on the roller assembly.

The advantages of the present invention are as follows. The lifting of the operation platform is realized through the cooperation of the lifting cylinder and the fixed plate, and the flipping of the operation platform is realized by the cooperation of the flipped cylinder, the operation platform, and the fixed plate. Through setting the placement groove, the hydraulic clamp mechanism runs to the end and is flipped with the working platform, so as to be placed on the operation platform. Additionally, the whole operation platform is flipped on the left side of the derrick, which reduces the occupation of space, and is convenient for transportation with the truck. It does not need to be equipped with hoisting, convenient and quick to move and disassemble. Moreover, the hydraulic clamp, the well support mechanism, and the centring mechanism are all centrally set up, convenient to utilize, namely, the present invention just need to be transported to the desired location without additional installation, and the present invention is suitable for existing minor repair operations. Meanwhile, the intensity of manual labor is reduced and safety accidents are avoided. The present invention effectively solves the problem that the existing workover equipment has a low degree of integration, and does not have a highly integrated operation platform, and requires on-site installation of hydraulic clamps and other mechanisms. The present invention also solves the problem that the prior workover equipment is inconvenient for transportation and required to spend a lot of manpower and material resources on installation and disassembly before and after use.

DETAILED DESCRIPTION OF THE EMBODIMENTS

Figure 1:
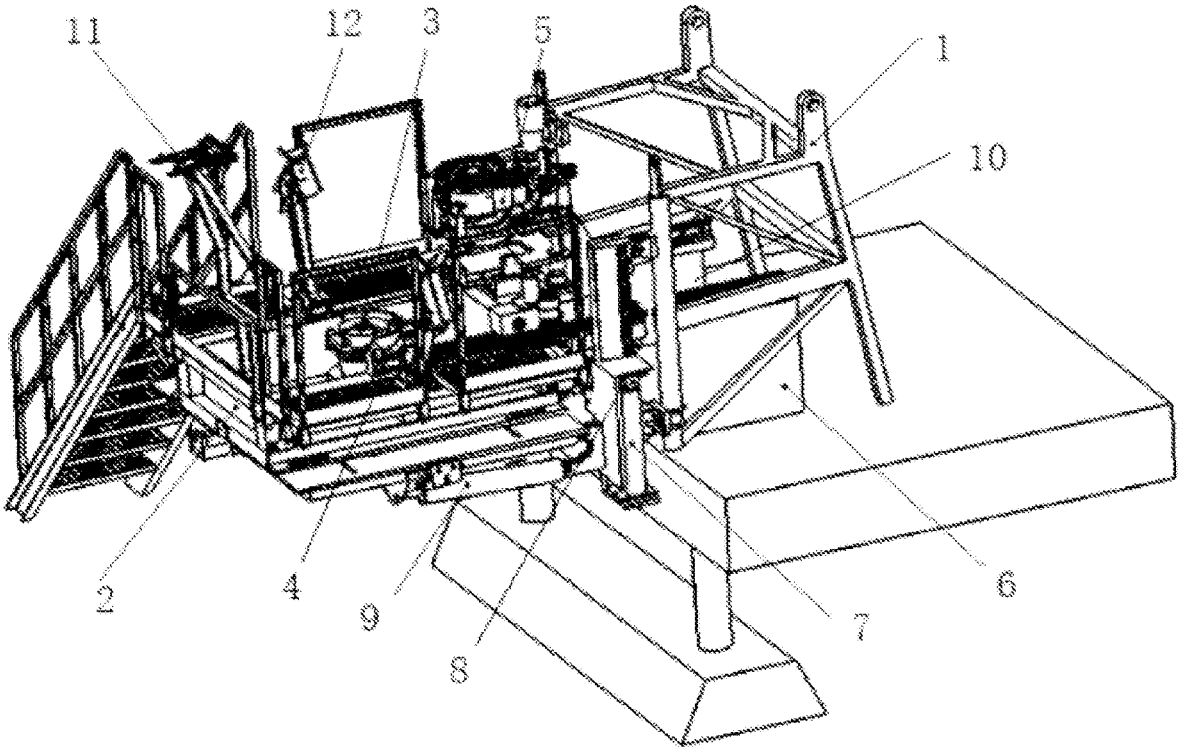
FIG. 1 is a structural schematic diagram of the present invention.
Figure 2:
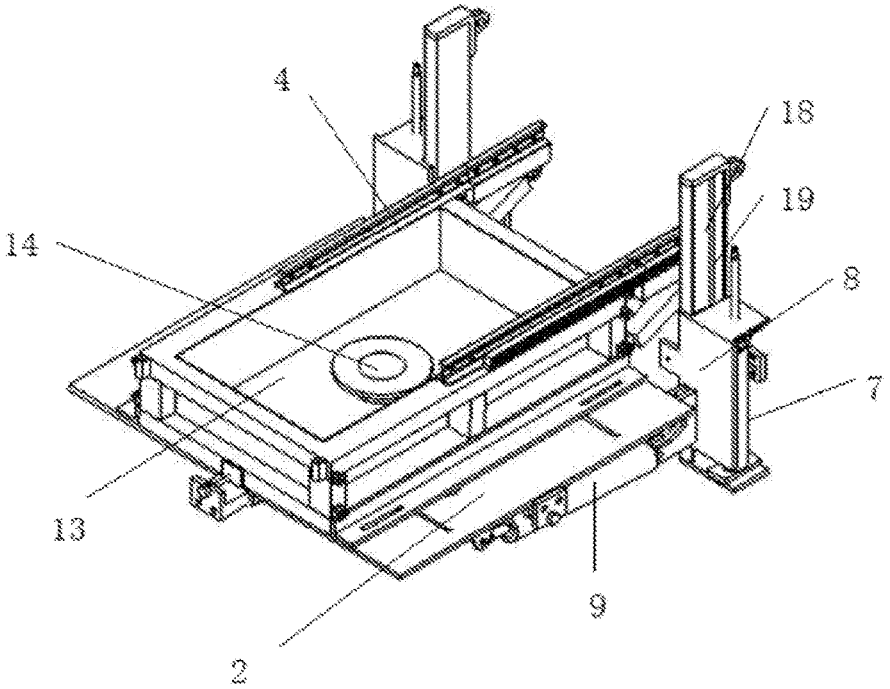
FIG. 2 is a structural schematic diagram of the operation platform of the present invention after flipping.
Figure 3:
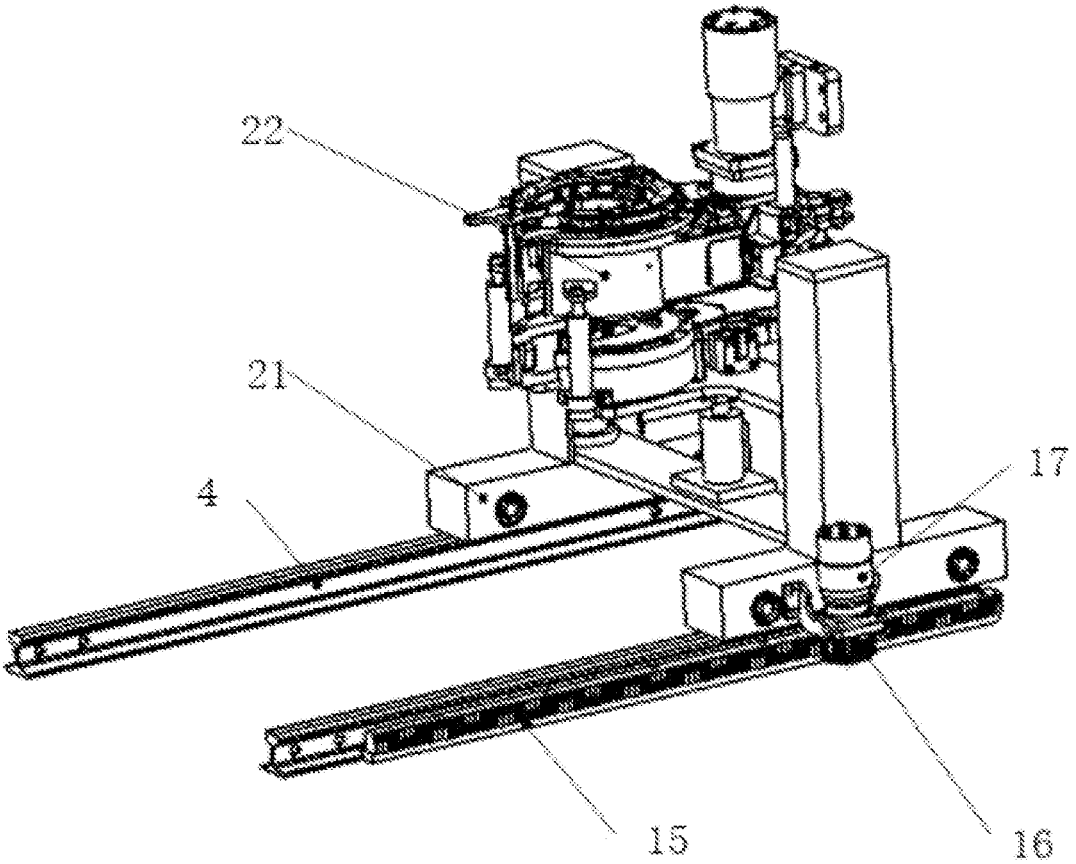
FIG. 3 is a structural schematic diagram of the position relationship of the guide rail and the hydraulic clamp mechanism.
Figure 4:
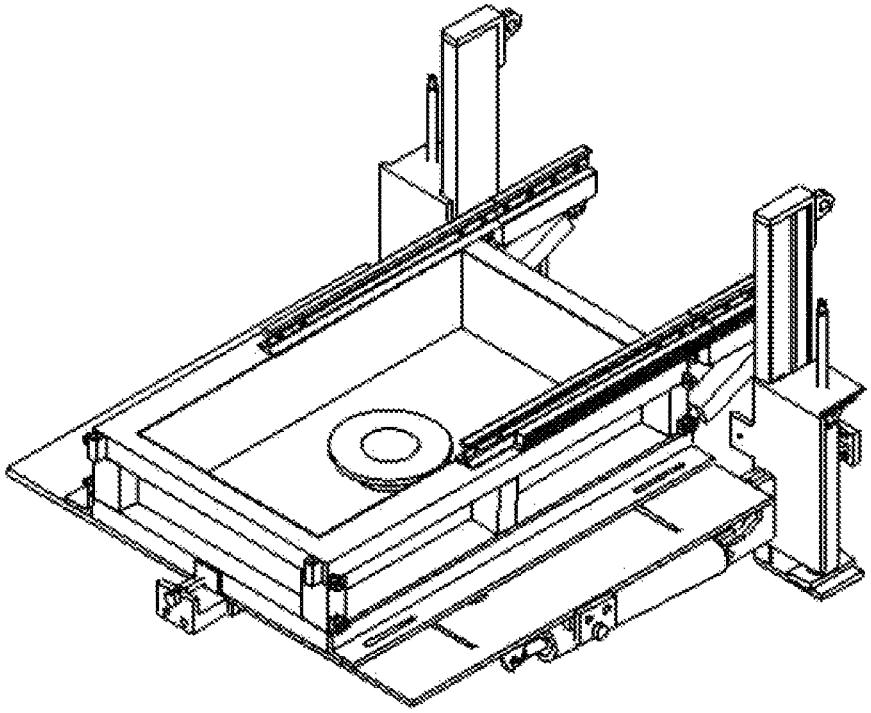
FIG. 4 is a structural schematic diagram of the operation platform.
Figure 5:
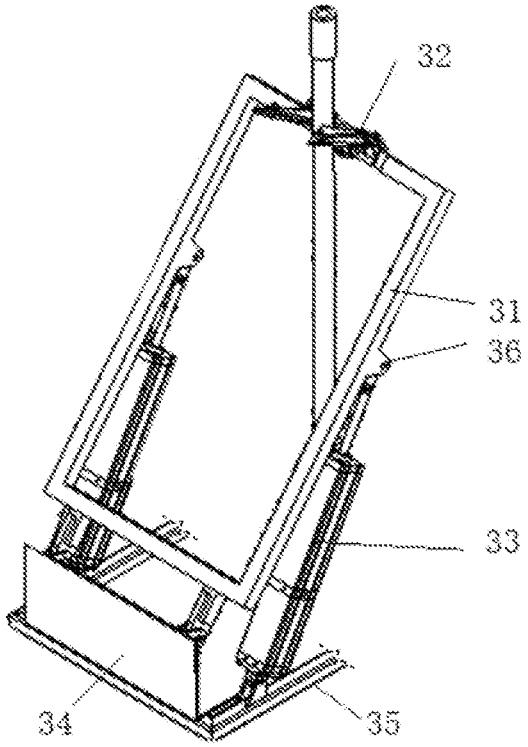
FIG. 5 is a structural schematic diagram of the well support mechanism.
Figure 6:
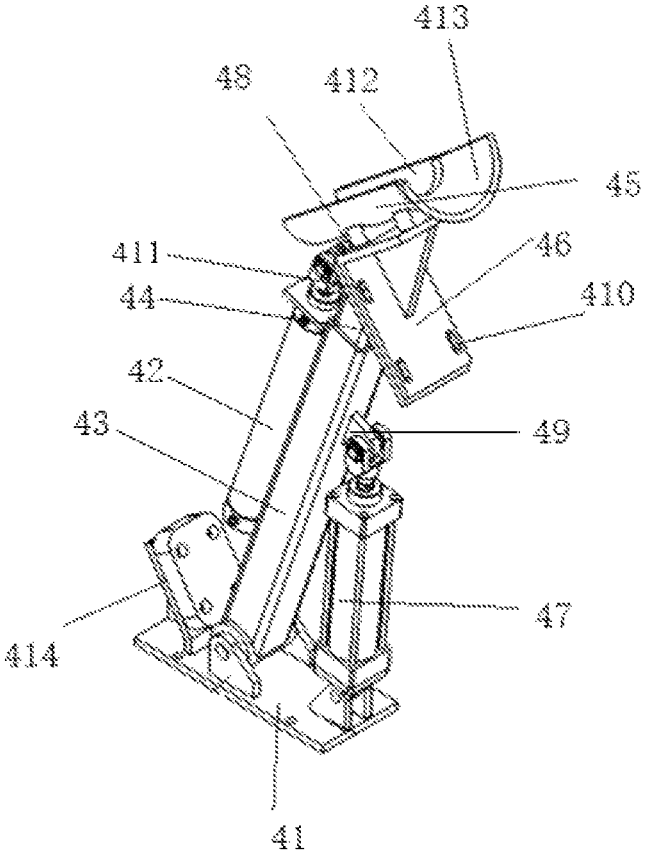
FIG. 6 is a structural schematic diagram of the centring mechanism.
Figure 7:
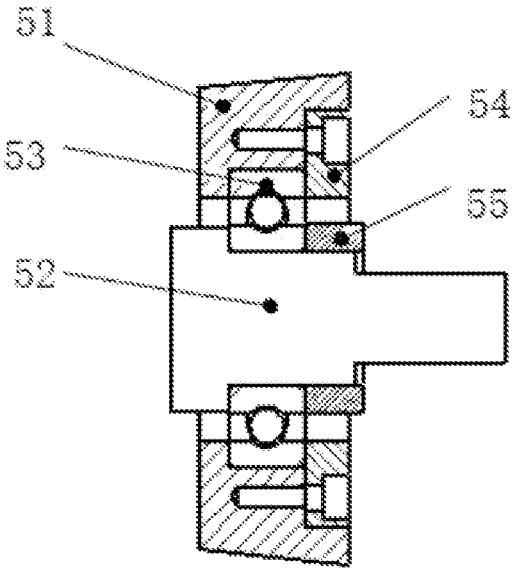
FIG. 7 is a structural schematic diagram of the roller assembly.

According to the embodiment, as shown in FIGS. 1 to 7, a truck-mounted flipped automated operation equipment for well workover includes the derrick 1 and the operation platform 2. The slip 3 for clamping the pipe string is arranged at the center of the operation platform 2, and the slip 3 is arranged on the flange of the pipe mouth 14 on the operation platform 2. The guide rail 4 is arranged on the front and back sides of the center of the operation platform 2, respectively, and the guide rail 4 is provided with the hydraulic clamp mechanism 5 configured to slide along the guide rail 4. The hydraulic clamp mechanism 5 includes the hydraulic clamp frame 21 and the hydraulic clamp 22 arranged on the hydraulic clamp frame 21. The inner clamp frame support 6 is arranged under the derrick 1, and the lifting cylinder 7 is fixed on the left side of the derrick 1. The piston part of the lifting cylinder 7 is provided with the fixed plate 8 configured to rise and fall with the lifting cylinder 7, and the right side of the operation platform 2 is hinged on the fixed plate 8. The fixed plate 8 is further provided with the flipped cylinder 9. The cylinder barrel of the flipped cylinder is hinged on the fixed plate 8, and the piston part of the flipped cylinder 9 is connected to the lower part of the operation platform 2. The inner clamp frame support 6 is provided with the placement groove 10 adapted to the hydraulic clamp mechanism 5. The hydraulic clamp mechanism 5 is configured to flip vertically with the operation platform 2, and when the hydraulic clamp mechanism 5 runs to the end of the guide rail 4, it is placed on the placement groove 10.

In the description of the present invention, it should be understood that "center", "transversal", "upper", "lower", "left", "right", "vertical", "horizontal", "top", "bottom", "inner/inside", "outer/outside" and other terminologies for indicating the orientation or position relationships are based on the orientation or position relationships shown in the drawings, only to facilitate the description of the present invention and to simplify the description, without indicating or implying that the device or element referred to must have a specific orientation, or be constructed and operated in the specific orientation, thereby they cannot be understood as a limitation to the present invention. In addition, the terminologies such as "first" and "second" are used only for descriptive purposes and cannot be understood to indicate or imply relative importance or implicitly indicate the number of technical features indicated. Thus, features defined by "first" and "second" may include one or more of these features either explicitly or implicitly. In the description of the present invention, unless otherwise stated, "a plurality of" means two or more. Additionally, the terminology "include/comprise" and any synonyms thereof are intended to cover non-exclusive inclusions.

In the description of the present invention, it should be noted that unless otherwise clearly stipulated and defined, the terminologies such as "installation", "connected" and "connection" should be understood in a broad sense, for example, it may be a fixed connection, a detachable connection, or an integrated connection; it may be a mechanical connection, or an electrical connection; it may be a direct connection, an indirect connection through an intermediary, or a communication between the interiors of two elements. For ordinary skilled in the art, the specific meaning of the above terminologies in the present invention can be understood in specific situations.

The terminologies used herein are only used to describe specific embodiments and are not intended to limit exemplary embodiments. Unless the context expressly refers, otherwise the singular forms "a" and "one" used here are also intended to include the plural. It should also be understood that the terminologies such as "including/comprising" and/or "containing" used herein specify the existence of the stated features, integers, steps, operations, units and/or components, without excluding the existence or addition of one or more other features, integers, steps, operations, units, components and/or combinations thereof.

The design of the present invention is further illustrated below in conjunction with FIGS. 1 to 7.

The truck-mounted flipped automated operation equipment for the well workover includes the derrick 1 and the operation platform 2. The slip 3 for clamping the pipe string is arranged at the center of the operation platform 2, and the slip 3 is arranged on the flange of the pipe mouth 14 on the operation platform 2. The guide rail 4 is arranged on the front and back sides of the center of the operation platform 2, respectively, and the guide rail 4 is provided with the hydraulic clamp mechanism 5 configured to slide along the guide rail 4. The hydraulic clamp mechanism 5 includes the hydraulic clamp frame 21 and the hydraulic clamp 22 arranged on the hydraulic clamp frame 21. The inner clamp frame support 6 is arranged under the derrick 1, and the lifting cylinder 7 is fixed on the left side of the derrick 1. The piston part of the lifting cylinder 7 is provided with the fixed plate 8 configured to rise and fall with the lifting cylinder 7, and the right side of the operation platform 2 is hinged on the fixed plate 8. The fixed plate 8 is further provided with the flipped cylinder 9. The cylinder barrel of the flipped cylinder is hinged on the fixed plate 8, and the piston part of the flipped cylinder 9 is connected to the lower part of the operation platform 2. The inner clamp frame support 6 is provided with the placement groove 10 adapted to the hydraulic clamp mechanism 5. The hydraulic clamp mechanism 5 is configured to flip vertically with the operation platform 2, and when the hydraulic clamp mechanism 5 runs to the end of the guide rail 4, it is placed on the placement groove 10.

The well support mechanism 11 is arranged on the left side of the operation platform 2 away from the derrick 1. The well support mechanism 11 includes the well support base installed on the operation platform 2. The flipped well support 31 is arranged on the well support base, and the grip 32 for clamping the pipe string is arranged on the well support 31. The three-position cylinder 33 is further arranged on the well support base. The cylinder barrel of the three-position cylinder 33 is hinged on the well support base, and the top of the piston part of the three-position cylinder 33 is connected to the well support 31.

The well support 31 is a square frame, and the bottom frame of the well support 31 is hinged on the well support base. The two three-position cylinders 33 are arranged, and the tops of the piston parts of the two three-position cylinders 33 are hinged with the front frame and the back frame of the well support 31, respectively. The grip 32 is arranged on the top frame of the well support 31.

The well support base includes the vertical well support base plate 34 and the well support base frame 35, and the vertical well support base plate 34 is vertically arranged on the well support base frame 35. The bottom frame of the well support 31 is hinged on the vertical well support base plate 34, and the cylinder barrels of the two three-position cylinders 33 are respectively hinged on the well support base frame 35. The well support, the vertical well support base plate 34 and the well support base frame 35 are respectively provided with the hinged lugs 36 for hinging. The grip 32 is detachably arranged on the top frame of the well support 31.

The front and back sides of the center of the operation platform 2 are symmetrically provided with the pipe string centring mechanism 12. The pipe string centring mechanism 12 includes the centring fixed base 41, and two centring mechanisms are symmetrically arranged on the centring fixed base 41 relative to the wellhead. Each centring mechanism includes the side push cylinder 42, the rotary base 43, the guide base 44, the semi-pipe positioning sleeve 45, the adjusting plate 46 and the side swing cylinder 47. The bottom of the rotary base 43 is hinged to the centring fixed base 41. The bottom of the cylinder barrel of the side swing cylinder 47 is hinged to the centring fixed base 41, and the piston part of the side swing cylinder 47 is hinged to the right side wall of the rotary base 43. The guide base 44 is retractably arranged on the top of the inner chamber of the rotary base 43. The cylinder barrel of the side push cylinder 42 is fixed on the left side wall of the rotary base 43, and the piston part of the side push cylinder 42 is hinged to the left side wall of the guide base 44. The adjusting plate 46 is arranged on the top of the guide base 44. The semi-pipe positioning sleeve 45 is arranged on the adjusting plate 46, and the semi-pipe positioning sleeve 45 is configured to clamp the pipe string. When the semi-pipe positioning sleeves 45 of the two centring mechanisms are docked with each other, the semi-pipe positioning sleeves 45 cooperate to clamp the pipe string. The right side wall of the rotary base 43 is provided with the right side wall hinged lug 49, and the left side wall of the guide base 44 is provided with the left side wall hinged lug 48. The piston part of the side swing cylinder 47 is hinged with the right side wall hinged lug 49, and the piston part of the side push cylinder 42 is hinged with the left side wall hinged lug 48.

The number of the centring fixed base 41 may be one. Alternatively, the centring fixed base 41 is respectively arranged for each group of centring mechanisms, and the centring fixed base 41 is provided with the side swing limiting plate 414 located on the left side of the bottom of the rotary base 43.

The rotary base 43 is configured to rotate 45°-60° in the left and right, and the rotation angle can be selected and adjusted as needed. 45°-60° are not used to construct a limitation to the present invention. The purpose of the present invention is that it can rotate in the left and right, and the specific rotation angle can be selected as needed, which can be less than 45° or more than 60°.

A group of assembly holes 410 are arranged at the adjusting plate 46, and the top of the guide base 44 is provided with the inserting keys 411 adapted to the assembly holes 410. The position of the adjusting plate 46 relative to the guide base 44 can be adjusted by inserting the inserting keys 411 into the assembly holes 410 of different positions. The number of inserting keys 411 is two, and two assembly holes 410 are arranged as one group. A plurality of groups of assembly holes 410 are arranged, and the two assembly holes 410 in each group are exactly matched with the two inserting keys 411.

Each semi-pipe positioning sleeve 45 includes the semi pipe 412 arranged vertically and the semi funnel 413 arranged at the top of the semi pipe 412. Two semi pipes 412 and two semi funnels 413 cooperate to respectively form a complete pipe sleeve and a complete funnel which are adapted to the pipe string. The semi pipe 412 and the semi funnel 413 are formed integrally or detachably.

The flipped cylinder 9 is arranged under the front and back sides of the operation platform 2, respectively. The lifting cylinder 7 is arranged at the front and back sides of the end of the operation platform 2, respectively.

The liquid accumulation tank 13 is arranged at the center of the operation platform 2, the pipe mouth 14 of the operation platform 2 is arranged at the center of the liquid accumulation tank 13, and the liquid discharge outlet is arranged at the bottom of the liquid accumulation tank 13.

The outer side wall of one of the two guide rails 4 is provided with the rack 15, and the rack 15 is engaged with and adapted to the gear 16. The outer side wall of the bottom of the hydraulic clamp frame is provided with the hydraulic motor 17, and the gear 16 is arranged on the rotating shaft of the hydraulic motor 17. When the operation platform 2 is placed horizontally, the end of the guide rail 4 extends to be placed above the placement groove 10, and when the operation platform 2 is flipped, the end of the guide rail 4 is placed in the placement groove 10.

The truck-mounted flipped automated operation equipment for the well workover further includes the standing column 18 fixed on the derrick 1, and the standing column 18 is provided with the guide groove 19. The roller assembly is arranged in the guide groove 19, and is configured to rise and fall along the guide groove 19. The roller assembly includes the roller 51 configured to rise and fall along the guide groove 19, and the center of the roller 51 is provided with the roller shaft 52. The lifting cylinder 7 is fixed at the bottom of the standing column 18, and the piston part of the lifting cylinder 7 is connected to the roller shaft 52. The fixed plate 8 is arranged on the roller assembly. The roller bearing 53, the pressing plate 54 and the spacer 55 are further arranged in the roller 51.

The above embodiments are not considered to limit the present invention, but are used for illustrating the present invention. The scope of the present invention depends on the scope of the claims, rather than the description, and it should be noted that all differences within the equivalent scope should be included in the present invention. If various non-substantive improvements are carried out by using the method conception and the technical solution of the present invention, or the above conception and technical solution of the present invention are directly applied to other occasions without improvement, they shall fall within the scope of protection of the present invention.

What is claimed is:

1. A truck-mounted flipped automated operation equipment for a well workover, comprising a derrick and an operation platform; wherein a slip for clamping a pipe string is arranged at a center of the operation platform, and the slip is arranged on a flange of a pipe mouth on the operation platform;

a guide rail is arranged on front and back sides of the center of the operation platform, respectively, and the guide rail is provided with a hydraulic clamp mechanism configured to slide along the guide rail;

the hydraulic clamp mechanism comprises a hydraulic clamp frame and a hydraulic clamp arranged on the hydraulic clamp frame;

an inner clamp frame support is arranged under the derrick, and a lifting cylinder is fixed on a left side of the derrick;

a piston part of the lifting cylinder is provided with a fixed plate configured to rise and fall with the lifting cylinder, and a right side of the operation platform is hinged on the fixed plate;

the fixed plate is further provided with a flipped cylinder; a cylinder barrel of the flipped cylinder is hinged on the fixed plate, and a piston part of the flipped cylinder is connected to a lower part of the operation platform;

the inner clamp frame support is provided with a placement groove adapted to the hydraulic clamp mechanism;

the hydraulic clamp mechanism is configured to flip vertically with the operation platform, and when the hydraulic clamp mechanism runs to an end of the guide rail, the hydraulic clamp mechanism is placed on the placement groove.

2. The truck-mounted flipped automated operation equipment for the well workover according to claim 1, wherein a flipped well support mechanism is arranged on the operation platform.

3. The truck-mounted flipped automated operation equipment for the well workover according to claim 1, wherein the front and back sides of the center of the operation platform are symmetrically provided with two pipe string centring mechanisms.

4. The truck-mounted flipped automated operation equipment for the well workover according to claim 3, wherein the flipped cylinder is arranged under front and back sides of the operation platform, respectively.

5. The truck-mounted flipped automated operation equipment for the well workover according to claim 4, wherein the lifting cylinder is arranged on front and back sides of an end of the operation platform, respectively.

6. The truck-mounted flipped automated operation equipment for the well workover according to claim 5, wherein a liquid accumulation tank is arranged at the center of the operation platform, the pipe mouth on the operation platform is arranged at a center of the liquid accumulation tank, and a liquid discharge outlet is arranged at a bottom of the liquid accumulation tank.

7. The truck-mounted flipped automated operation equipment for the well workover according to claim 6, wherein an outer side wall of the guide rail is provided with a rack, and the rack is engaged with and adapted to a gear;

an outer side wall of a bottom of the hydraulic clamp frame is provided with a hydraulic motor, and the gear is arranged on a rotating shaft of the hydraulic motor;

when the operation platform is placed horizontally, the end of the guide rail extends to be placed above the placement groove.

8. The truck-mounted flipped automated operation equipment for the well workover according to claim 7, further comprising a well support base installed on the operation platform, wherein a flipped well support is hinged on the well support base, and a grip for clamping the pipe string is arranged on the flipped well support;

a three-position cylinder is arranged on the well support base;

a cylinder barrel of the three-position cylinder is hinged on the well support base, and a top of a piston part of the three-position cylinder is connected to the flipped well support;

the flipped well support is a square frame, and a bottom frame of the flipped well support is hinged on the well support base;

wherein two three-position cylinders are arranged, and a top of a piston part of each of the two three-position cylinders is hinged with a front frame and a back frame of the flipped well support, respectively; and the grip is arranged on a top frame of the flipped well support.

9. The truck-mounted flipped automated operation equipment for the well workover according to claim 8, wherein each of the two pipe string centring mechanisms comprises a centring fixed base, wherein the two centring mechanisms are symmetrically arranged on the centring fixed base relative to a wellhead;

each of the two pipe string centring mechanisms comprises a side push cylinder, a rotary base, a guide base, a semi-pipe positioning sleeve, an adjusting plate, and a side swing cylinder; wherein a bottom of the rotary base is hinged on the centring fixed base;

a bottom of a cylinder barrel of the side swing cylinder is hinged on the centring fixed base, and a piston part of the side swing cylinder is hinged on a right side wall of the rotary base;

the guide base is retractably arranged on a top of an inner chamber of the rotary base;

a cylinder barrel of the side push cylinder is fixed on a left side wall of the rotary base, and a piston part of the side push cylinder is hinged on a left side wall of the guide base;

the adjusting plate is arranged on a top of the guide base;

the semi-pipe positioning sleeve is arranged on the adjusting plate, and the semi-pipe positioning sleeve is configured to clamp the pipe string;

when semi-pipe positioning sleeves of the two pipe string centring mechanisms are docked with each other, the semi-pipe positioning sleeves cooperate to clamp the pipe string.

10. The truck-mounted flipped automated operation equipment for the well workover according to claim 9, further comprising a standing column fixed on the derrick, wherein the standing column is provided with a guide groove;

a roller assembly is arranged in the guide groove, and is configured to rise and fall along the guide groove;

the roller assembly comprises a roller configured to rise and fall along the guide groove, and a center of the roller is provided with a roller shaft;

the lifting cylinder is fixed at a bottom of the standing column, and the piston part of the lifting cylinder is connected to the roller shaft; and the fixed plate is arranged on the roller assembly.

11. The truck-mounted flipped automated operation equipment for the well workover according to claim 3, wherein a flipped well support mechanism is arranged on the operation platform.

* * * * *